US005275698A

United States Patent [19]

Dasgupta et al.

[11] Patent Number: 5,275,698

[45] Date of Patent: Jan. 4, 1994

[54] ENHANCEMENT OF TISSUE PAPER SOFTNESS WITH MINIMAL EFFECT ON STRENGTH

[75] Inventors: Sunil P. Dasgupta; Herbert H. Espy, both of Wilmington, Del.

[73] Assignee: Hercules Incorporated, Wilmington, Del.

[21] Appl. No.: 849,111

[22] Filed: Mar. 9, 1992

[51] Int. Cl.[5] ..... D21H 17/25

[52] U.S. Cl. ..... 162/177; 162/111; 162/183

[58] Field of Search ..... 162/111, 112, 175, 177, 162/183

[56] References Cited

U.S. PATENT DOCUMENTS 2,033,481 3/1936 Richter ..... 162/177
2,285,490 6/1942 Broderick ..... 162/177
2,766,137 10/1956 Ashton ..... 162/177
4,158,594 6/1979 Becker et al. ..... 162/112

OTHER PUBLICATIONS

Horsey, "Sodium Carboxymethylcellulose for Papermaking", *Paper Trade Journal*, vol. 125, No. 4 pp. 40–44.

*Primary Examiner*—Peter Chin
*Attorney, Agent, or Firm*—Roy V. Jackson

[57] ABSTRACT

A process for making paper to enhance the softness of the paper produced without reducing its dry strength comprises adding to the pulp slurry as a binder resin a cellulosic polymer that exhibits a cloud point in aqueous solution, and allowing the dissolved polymer to coalesce into fine colloidal particles at a temperature above the cloud point either before or after it is added to the slurry.

9 Claims, No Drawings

ENHANCEMENT OF TISSUE PAPER SOFTNESS WITH MINIMAL EFFECT ON STRENGTH

This invention relates to a process for making paper to enhance the softness of the paper produced without reducing its dry strength.

BACKGROUND OF THE INVENTION

One of the major goals of tissue manufacturers is to enhance softness without any significant reduction of dry strength. Softness combined with adequate dry strength is a very important property in paper used for making high quality tissues and toweling, and any method for increasing the softness of a paper sheet without significantly damaging its strength is desirable. Since bulk or puffiness of paper is a major contributor to its softness, however, increasing softness by increasing the bulk of paper reduces its strength, because of the lower density of fiber per unit volume.

U.S. Pat. No. 4,158,594 discloses a method for differentially creping a fibrous sheet to which a water solution of carboxymethyl cellulose has been applied in a selected bonding pattern. Any improvement in tensile strength and softness depends on the effect of adhering the bonded parts of the web to the creping drum.

There is an unfilled need for an effective additive that will enhance softness without causing a significant reduction in dry strength, without depending on a creping step.

SUMMARY OF THE INVENTION

According to the invention, a process for making paper comprising adding to the pulp slurry as a binder resin a cellulosic polymer that exhibits a cloud point in aqueous solution, of about 10° and about 95° C. and selected from the group consisting of methyl cellulose, hydroxypropyl cellulose, methyl hydroxyethyl cellulose, methyl hydroxypropyl cellulose, methyl hydroxybutyl cellulose, and carboxyethyl methyl cellulose methyl cellulose ("MC"), hydroxypropyl cellulose ("HPC"), methyl hydroxyethyl cellulose ("MHEC"), methyl hydroxypropyl cellulose ("MHPC"), methyl hydroxybutyl cellulose ("MHBC"), and carboxyethyl methyl cellulose ("CEMC"), and allowing the dissolved polymer to coalesce into fine colloidal particles at a temperature above the cloud point.

The cellulosic polymers that have cloud points have an inverse dependence of solubility on temperature, and it is thought that when the colloidal particles are deposited on the surface of the fibers, the particles between the adjacent fibers in the finished sheet will contribute to bonding, while avoiding any adverse effect on the flexibility of the fiber network or on the resulting softness of the sheet.

To achieve this result, the polymer may be added as an aqueous solution that is at a temperature below the cloud point, to a paper slurry that is at a temperature above the cloud point, so that the polymer will coalesce to colloidal form as it disperses through the pulp slurry.

As one alternative method, both the diluted polymer and the paper slurry may be at a temperature above the cloud point of the polymer, so that the polymer is already in the colloidal form at the moment of addition. As a further alternative, both the polymer solution and the paper slurry may be below the cloud point of the polymer, and the wet sheet may be heated to above the cloud point as it passes through the dryer, provided that enough water remains for the newly formed colloidal particles to migrate among the fibers.

DETAILED DESCRIPTION OF INVENTION

The cloud point of a cellulosic polymer will depend on the kind of substituents, their degree of substitution, and to the average molecular weight of the polymer. If the cloud point is below about 10° C., dispersion of the solid polymer (before feeding it to the paper machine) will require the use of colder water than may be available in a paper mill. If the cloud point is above about 95° C., and the polymer is added in solution, the slurry temperature will not be above the cloud point and it may not be convenient to raise the temperature of the water in the sheet enough during drying to precipitate the polymer as a colloid at the drying stage, nor to maintain an existing colloid produced by adding it in water already above the cloud point.

More preferably, the cloud points lies between 20° and 80° C., and most preferably, between 35° C. and 65° C., because that range of temperatures is conveniently used in the operation of most paper machines.

Suitable polymers can be selected readily by consulting manufactures, trade literature for cloud points. Examples of cellulosic polymers exhibiting cloud points an acceptable range include methyl cellulose ("MC"), hydroxypropyl cellulose ("HPC"), methyl hydroxyethyl cellulose ("MHEC"), methyl hydroxypropyl cellulose ("MHPC"), methyl hydroxybutyl cellulose ("MHBC"), and carboxyethyl methyl cellulose ("CEMC"). Of these, HPC and MC are preferred because their cloud points fall within the most preferred range. Especially preferred is HPC, commercially available from Hercules Incorporated as Klucel® GF hydroxypropyl cellulose, which is a medium molecular size product with a 2% solution viscosity of 150–400 cps. Klucel® GF hydroxypropyl cellulose is completely soluble in water below 45° C. and is insoluble above 45° C. Fine colloidal particles are formed that can be maintained in a dispersed state when an aqueous solution of Klucel® GF hydroxypropyl cellulose is subjected to a temperature just above 45° C.

If the polymer solution and the pulp slurry are both below the cloud point, the polymer will remain in solution and can not be expected to be substantive to the pulp. The concentration in the water at a given instant will be that needed to deposit enough in the sheet to impart the desired combination of strength and flexibility, after drying above the cloud point temperature. This concentration will be calculated from the amount wanted in the sheet, and the ratio of dry pulp fibers to water in the wet web entering the dryer. At equilibrium, the rate of polymer addition to the machine will equal the rate of polymer removal by way of the paper produced.

The amount of polymer in the slurry is chosen depending on the magnitude of the effect desired in the grade of paper being produced. Preferably, the amount will correspond to between about 0.1% and about 2% of the polymer, based on weight of dry fiber in the sheet produced. More preferably, the amount of polymer in the paper is between 0.5% and 1%. To achieve those proportions, the concentration of polymer in the slurry should preferably be maintained between 0.0002% and 0.004%, more preferably between 0.001% and 0.002%, assuming paper is prepared from 0.2% pulp slurry.

If the slurry temperature is above the cloud point, the colloidally dispersed polymer will be already available to adhere to the pulp fiber surface. Optionally, an ionic water-soluble polymer can be added as a retention aid. Many suitable cationic polymers are known to the art as retention aids for mineral fillers such as kaolin, talc, titanium dioxide, calcium carbonate, etc. in printing papers. Such polymers include polyamines, amine-epichlorohydrin resins, polyamine-epichlorohydrin resins, poly(aminoamide)-epichlorohydrin resins, cationic or anionic modified polyacrylamides, etc. A choice among many such commercial polymers can be made after routine experimentation. It is preferred to use amine-epichlorohydrin resin, polyamine epichlorohydrin resins, or poly(aminoamide)-epichlorohydrin resins, because they are readily available in concentrated solution form and are easily diluted before addition. When a retention aid is used, it may be added to the pulp either before or after the cellulosic polymer.

The pulps used may be those customarily used in the production of sanitary tissue or toweling. These pulps include but are not limited to: hardwood and softwood species, pulped by kraft, recycled pulp, sulfate, alkali, sulfite, thermomechanical, or chemithermomechanical pulp (CTMP), and may be bleached or unbleached.

EXAMPLES

Klucel® hydroxypropyl cellulose is a nonionic water-soluble cellulose ether. Klucel® GF represents a medium molecular size product with a 2% solution viscosity of 150–400 cps. Klucel® has a unique solubility property in water. It is completely soluble in water at a temperature below 45° C. and is insoluble above 45° C. Fine colloidal particles are formed that can be maintained in a dispersed state when an aqueous solution of Klucel® is subjected to a temperature just above 45° C.

Handsheet Preparation

The pulp was refined in a Valley beater to 500 Canadian Standard freeness. The 2.50% consistency pulp slurry was diluted to 0.322% solid with normal tap water in a Proportioner, where proportions of polymer ranging from 0.5% to 2% by weight of pulp solids were added to the pulp while stirring at room temperature, as well, as well as any retention aid. The concentration of polymer in the Proportioner was therefore from 0.0016 to 0.0064% on the same basis.

Aliquots of this pulp slurry were further diluted in a deckle box to the proper consistency for molding handsheets. Both refining and papermaking were made at 7.5 to 8.0 pH.

Using Klucel® GF as the polymer, the slurry temperature in the deckle box was about 45° C. for preparation of the handsheets.

Testing Evaluation Procedures

Tensile strength and modulus of papersheets were determined on an Instron® tensile tester at a drawing rate of 0.5" and a span of 4" for a 1" wide sample. The tensile stiffness (ST) was calculated from modulus (E) and thickness of paper (t) from the relation: $ST=E \cdot t$.

Bending stiffness was measured in a Handle O'Meter (Thwing Albert Instrument Co. Philadelphia, Pa.). The instrument measures the property of a papersheet that is basically influenced by its flexibility, surface smoothness, and thickness. Bending stiffness of a papersheet is known to correlate to its softness. Brightness and opacity of paper were measured in a Diano-S-4 brightness tester.

Paper Properties

The results presented in Tables 1 and 2 show that 0.2 to 1.0 percent addition of Klucel® GF has not adversely affected the tensile strength of paper, but rather shows a significant increase of about 8%. However, the tensile stiffness and bending stiffness of paper were significantly reduced, corresponding to increased softness, and presumably attributable to discrete spot paper-to paper bondings induced by the colloidal Klucel® particles, instead of to continuous rigid bonding.

TABLE 1

EXAMPLE 1
HANDSHEET PROPERTIES
PULP: 70/30 NSK/CTMP

| ADDITIVE | TENSILE STRENGTH (psi) | MODULUS (psi) | TENSILE STIFFNESS (p/i) | BENDING STIFFNESS (g/in.) |
|---|---|---|---|---|
| None | 8,890 | 912,000 | 3,849 | 165 |
| 1A. 0.5% Klucel® GF | 9,240 | 846,000 | 3,384 | 106 |
| 1B. 1.0% Klucel® GF | 9,100 | 774,000 | 2,941 | 105 |
| 1C. 0.5% Klucel® GF + 0.5% Reten 200 | 9,580 | 875,000 | 3,500 | 114 |

NSK = Northern Softwood Kraft
CTMP = Chemithermomechanical Pulp
p/i = pound per inch
g/in. = gram per inch
psi = pound per square inch

TABLE 2

PULP: 70/30 NSK/CTMP

| ADDITIVE | TENSILE STRENGTH (psi) | MODULUS (psi) | TENSILE STIFFNESS (p/i) | BENDING STIFFNESS (g/in.) |
|---|---|---|---|---|
| None | 9,030 | 762,000 | 3,139 | 163 |
| 2A. 0.2% Klucel® GF | 9,797 | 937,000 | 3,673 | 138 |
| 2B. 1.0% Klucel® GF + | 9,330 | 854,000 | 3,425 | 130 |

TABLE 2-continued

| ADDITIVE | PULP: 70/30 NSK/CTMP TENSILE STRENGTH (psi) | MODULUS (psi) | TENSILE STIFFNESS (p/i) | BENDING STIFFNESS (g/in.) |
|---|---|---|---|---|
| 0.5% Reten ® 200 | | | | |

NSK = Northern Softwood Kraft
CTMP = Chemithermomechanical Pulp
p/i = pound per inch
g/in. = gram per inch
psi = pound per square inch The procedures of Examples 1 and 2 were repeated with the Klucel ® GF hydroxypropyl cellulose successively replaced with methyl cellulose, methyl hydroxyethyl cellulose, methyl hydroxypropyl cellulose, methyl hydroxybutyl cellulose, and carboxymethyl methyl cellulose. Results similar to those reported in Tables 1 and 2 were obtained.

We claim:

1. A process for making paper to enhance the softness of the paper produced without reducing its dry strength comprises dissolving in water a cellulosic polymer that exhibits a cloud point in aqueous solution of between about 10° C. and about 95° C. and is selected from the group consisting of methyl cellulose, hydroxypropyl cellulose, methyl hydroxyethyl cellulose, methyl hydroxypropyl cellulose, methyl hydroxybutyl cellulose, and carboxyethyl methyl cellulose, adding the polymer to the pulp slurry as a binder resin, the polymer being caused to coalesce into fine colloidal particles at a temperature above the cloud point either before or after it is added to the slurry.

2. A process for making paper as claimed in claim 1, in which the cellulosic polymer has a cloud point between 20° C. and 80° C.

3. A process for making paper as claimed in claim 2, in which the cellulosic polymer has a cloud point between 35° C. and 65° C.

4. A process for making paper as claimed in claim 1, in which the cellulosic polymer is hydroxypropyl cellulose having a 2% solution viscosity of 150–400 cps.

5. A process for making paper as claimed in claim 1, in which an aqueous solution of the cellulosic polymer is added to the pulp slurry at a temperature below the cloud point and the pulp slurry is heated to a temperature above the cloud point before the pulp is dried.

6. A process for making paper as claimed in claim 5, in which the cellulosic polymer has a cloud point between 35° C. and 65° C.

7. A process for making paper as claimed in claim 6, in which the cellulosic polymer is hydroxypropyl cellulose.

8. A process for making paper as claimed in claim 5, in which a retention aid is also added to the pulp slurry.

9. A process for making paper as claimed in claim 1, further characterized in that the cellulosic polymer is a nonionic water-soluble cellulose ether with a 2% solution viscosity of 150–400 cps.

* * * * *

UNITED STATES PATENT AND TRADEMARK OFFICE

CERTIFICATE OF CORRECTION

PATENT NO. : 5,275,698

DATED : January 4, 1994

INVENTOR(S) : Sunil P. Dasgupta and Herbert H. Espy

It is certified that error appears in the above-identified patent and that said Letters Patent is hereby corrected as shown below:

Col. 2, line 24, "manufactures, trade" should read --manufactures' trade--;

Col. 4, lines 37 and 38, "paper-to paper" should read --paper-to-paper--;

Col. 4, the heading for Example 1, Table 1 is incorrect.

| | | |
|---|---|---|
| "TABLE 1 EXAMPLE 1 HANDSHEET PROPERTIES PULP:70/30 NSK/CTMP" | should read | "EXAMPLE 1 TABLE 1: HANDSHEET PROPERTIES PULP: 70/30 NSK/CTMP". |

Column 4, under the heading TABLE 2, and in Column 5, under the heading TABLE 2 - continued,

| | | |
|---|---|---|
| PULP: 70/30 NSK/CTMP" | should read | "TABLE 2: HANDSHEET PROPERTIES" PULP: 70/30 NSK/CTMP". |

Signed and Sealed this

Fourteenth Day of June, 1994

*Attest:*

*Attesting Officer*

Bruce Lehman

BRUCE LEHMAN

*Commissioner of Patents and Trademarks*